United States Patent [19]

Bower

[11] 4,060,110

[45] Nov. 29, 1977

[54] VAPOR RECOVERY NOZZLE

[75] Inventor: Allen M. Bower, Conneaut, Ohio

[73] Assignee: Emco Wheaton Inc., Conneaut, Ohio

[21] Appl. No.: 728,378

[22] Filed: Sept. 30, 1976

[51] Int. Cl.[2] ..... B65B 31/00; B67C 3/28

[52] U.S. Cl. ..... 141/207; 141/DIG. 1

[58] Field of Search ..... 141/198–229, 141/59, 301, 302, 1, 4, 5, 44, 52, 93, 346, 347, 383, 384, 385, 386, 392, DIG. 1; 220/85 VR, 85 VS, 86 R

[56] References Cited

U.S. PATENT DOCUMENTS

| | | | |
|---|---|---|---|
| 3,521,679 | 7/1970 | Copony | 141/208 |
| 3,911,973 | 10/1975 | Casteline | 141/59 |

*Primary Examiner*—Houston S. Bell, Jr.
*Attorney, Agent, or Firm*—Fetherstonhaugh & Co.

[57] ABSTRACT

An automatic dispensing nozzle of the type incorporating a vapor recovery system wherein the sealing seat for preventing the escape of recovered vapors from the system when the nozzle is not in use is located at the position along the length of the discharge tube which is not located within the filling tube of a fluid storage tank in use. The sealing seat for the vapor recovery shroud is located rearwardly from the outer end of the discharge tube and seal closure means is disposed within the shroud and spaced a substantial distance rearwardly from the outer end of the shroud to sealingly engage the sealing seat when the shroud is in its extended position. A mechanism is also provided for preventing the operation of the dispenser nozzle until the vapor recovery system of the nozzle is in communication with the interior of the tank which is to be filled by the nozzle. This mechanism consists of a simple magnetically operated mechanism for opening and closing a secondary vent passage in the vent tube of an automatic nozzle of the type having a vacuum operated release mechanism for automatically closing the flow control valve. The secondary vent passage communicates between the primary vent passage and the liquid discharge passage in the nozzle. Closure means for closing the secondary vent passage is mounted within the discharge tube for movement between a first position in which the secondary vent passage is opened and a second position in which the secondary vent passage is closed and magnetic activator means is carried by the shroud for moving the closure means to said open position when the shroud is extended whereby normal venting may be disrupted and to the closed position when the shroud is retracted, thereby permitting normal venting of the vacuum operated release mechanism.

15 Claims, 6 Drawing Figures

FIG. 3
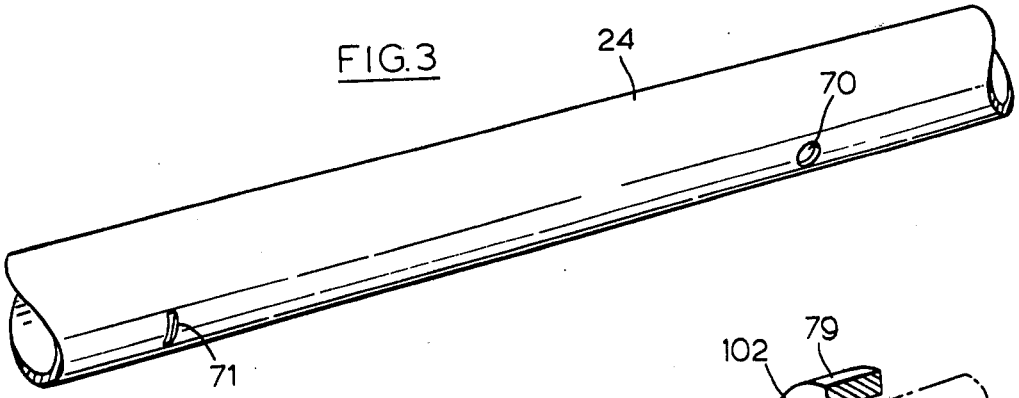
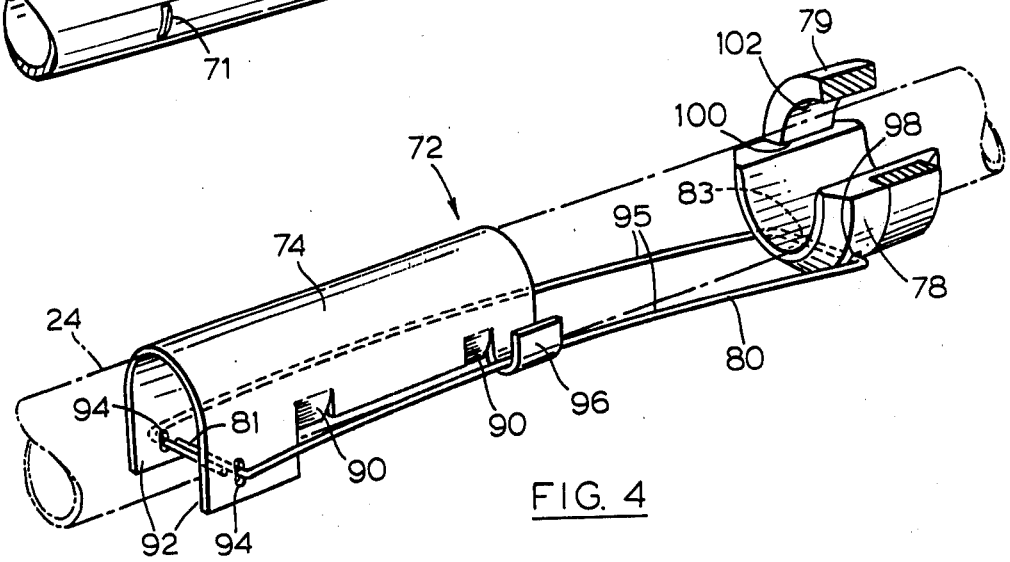
FIG. 4
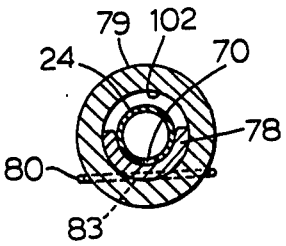
FIG. 5
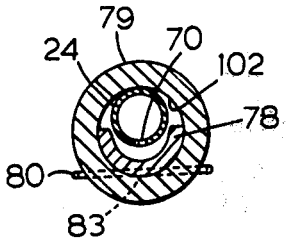
FIG. 6

VAPOR RECOVERY NOZZLE

FIELD OF INVENTION

This invention relates to automatic dispensing nozzles and in particular to nozzles incorporating a vapour recovery system.

PRIOR ART

In vapour recovery systems, it is important to provide a seal between the discharge tube of the nozzle and the shroud to prevent the escape of recovered vapours from the system when the nozzle is not in use. Previously this seal has been provided by forming an annular seat on the discharge tube which sealingly engages the sealing collar located at the outer end of the shroud. This sealing collar is used to form a vapour recovery seal between the shroud and the end of the filling tube of a gasoline tank which is to be filled by the nozzle in use. The annular seat is located at a point on the discharge tube which is located within the filling tube of the liquid storage tank in use and forms a lip which serves to make the nozzle self-supporting within the filling tube of a gasoline storage tank of an automobile or the like.

It has been found that the location of the annular seat on a portion of the discharge tube which is to be located within the filling tube of a fuel storage tank makes the insertion of the discharge tube within the filling tube a difficult operation because the sealing collar effectively increases the diameter of the discharge tube. In some instances, the filling tube of a gasoline storage tank has a series of tight bends at the outer end thereof which cannot be negotiated by a discharge tube of a nozzle having a collar located thereon.

It has been found that this difficulty can be overcome by relocating the sealing seat at a position along the length of the discharge tube which is not located within the filling tube of a fluid storage tank in use and by providing an additional sealing member located within the shroud for engagement therewith.

Various mechanism have been provided for preventing the operation of the dispenser nozzle until the vapour recovery system of the nozzle is in communication of the interior of the tank which is to be filled by the nozzle. These mechanisms have been complex and unreliable. It has been found that this difficulty can be overcome by providing a simple magnetically operating mechanism for opening and closing a secondary vent passage in the vent tube of an automatic nozzle of the type having a vacuum operator release mechanism for automatically closing the flow control valve.

SUMMARY OF INVENTION

According to one aspect of the present invention there is provided in a vapour recovery dispenser nozzle having a main body portion, a discharge tube projecting from one end of the main body portion, said discharge tube having an outer end portion thereof proportioned for ease of insertion into a filling tube of a liquid storage tank, a liquid flow passage extending through said main body and said discharge tube, vapour recovery passage means formed in said main body, an extensible vapour recovery shroud having an inner end and an outer end, said inner end of said shroud being mounted on said main body and communicating with said vapour recovery passage means of said main body, said shroud being disposed radially outwardly from said discharge tube and being movable between an extended position and a retracted position with respect to said main body, said shroud being normally urged towards said extended position, a first sealing collar at the outer end of said shroud for engagement with the end of the filling tube of a gas tank during filling thereof to direct vapour which is expelled from the tank to the vapour recovery passage means in the main body by way of the shroud, the improvement of sealing seat means of said discharge tube, said sealing seat means being located rearwardly from said outer end portion of said discharge tube to be disposed outwardly from the end of the filling tube of a liquid storage tank in use, second seal closure means disposed within said shroud and spaced a substantial distance rearwardly from said outer end of said shroud, said second seal closure means sealingly engaging said sealing seat means when said shroud is in its extended position whereby vapour which is located inwardly thereof cannot escape from within the shroud by way of the outer end thereof, said seal closure means being moved rearwardly away from said sealing seat when said shroud is moved to its retracted position in use whereby vapour expelled from the tank during filling may be directed through the shroud to the vapour recovery passage means of the main body.

According to a further aspect of the present invention there is provided in a vapour recovery liquid dispensing nozzle of the type having a vacuum operated release mechanism for automatically closing the flow control valve when the level of liquid in a tank being filled thereby rises to a level closing the end of the primary vent passage of the vent tube, the vent tube extending through the liquid discharge passage of the nozzle, and an extensible vapour recovery shroud extending about the discharge tube for directing vapour to the recovery passage of the nozzle, the shroud being movable from an extended position to a retracted position when the nozzle is operatively located within the neck of a liquid storage tank with the vapour recovery passage thereof communicating with the tank by way of the shroud, the improvement of a secondary vent passage means in said vent tube communicating between the primary vent passage and the liquid discharge passage in the nozzle, whereby the flow of liquid through the discharge passage may distrupt the normal venting and activate the vacuum operated release mechanism to close the flow control valve, closure means mounted within said discharge tube for movement between the first position in which said secondary vent passage is open and a second position in which said secondary vent passage is closed, and magnetic activator means carried by said shroud, said magnetic activator means moving said closure means to said open position when the shroud is extended whereby normal venting may be disrupted and to the closed position when the shroud is retracted, thereby permitting normal venting of said vacuum operated release mechanism.

The invention will be more clearly understood after reference to the following detailed specification read in conjunction with the accompanying drawings wherein FIG. 1 is a longitudinal sectional view of a nozzle according to an embodiment of the present invention;

FIG. 3 is a view of the underside of the vent tube;

FIG. 4 is a partially exploded pictorial view of the secondary vent passage closure mechanism;

FIG. 5 is a sectional view through the vent tube and valve member of the secondary vent passage closure mechanism showing the valve mechanism in the closed position; and FIG. 6 is a view similar to FIG. 5 showing the valve mechanism in the open position.

Automatic dispenser nozzles of the type having a vacuum operated release mechanism for automatically closing the flow control valve when the level of liquid in the tank being filled thereby rises to a level closing the end of the vent passage, are well known. A vapour recovery dispenser nozzle of this type is described in U.S. Pat. No. 3,974,864 dated Aug. 17, 1976 and assigned to Emco Wheaton Inc.

Figure 1:
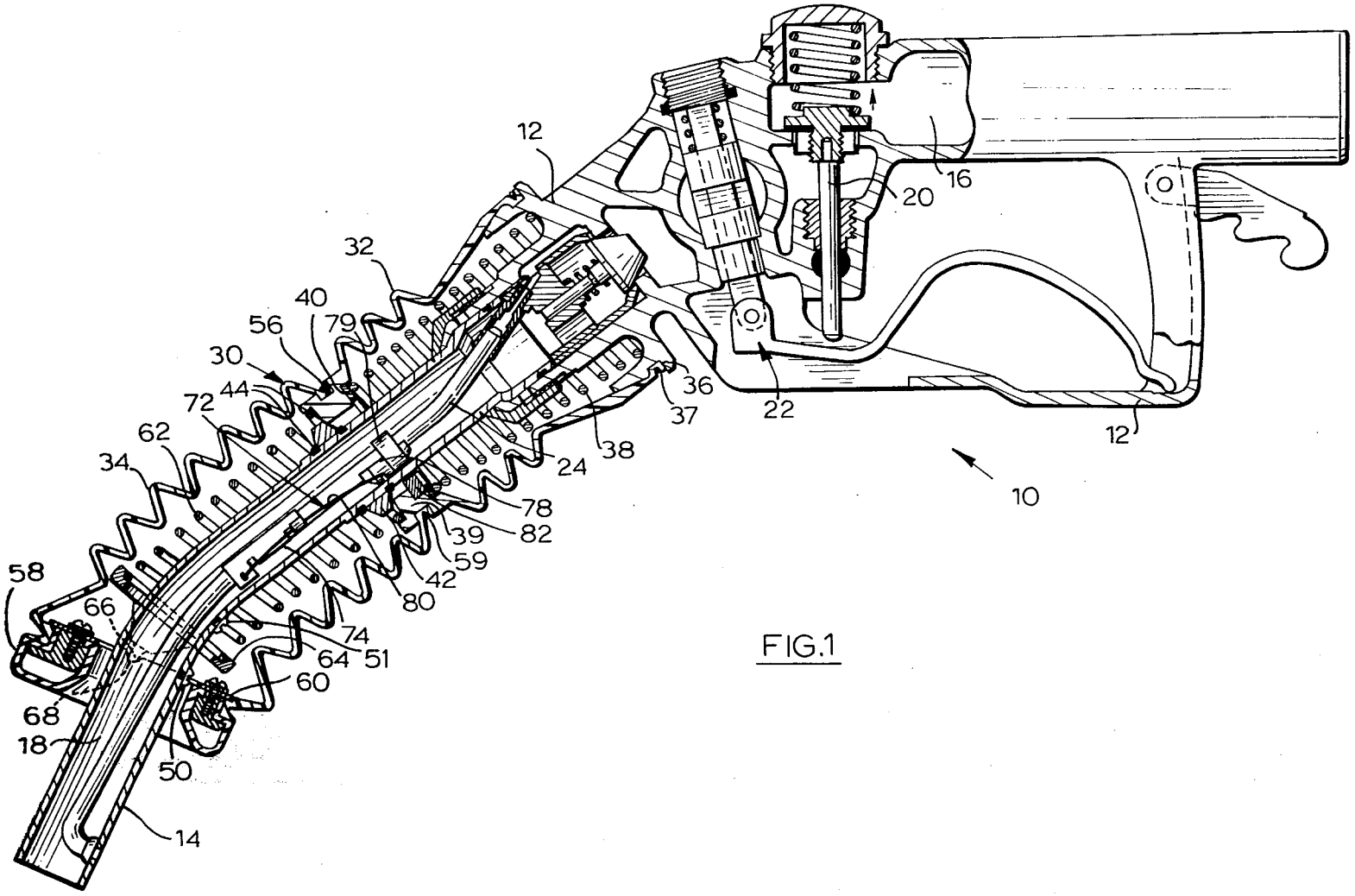
Figure 2:
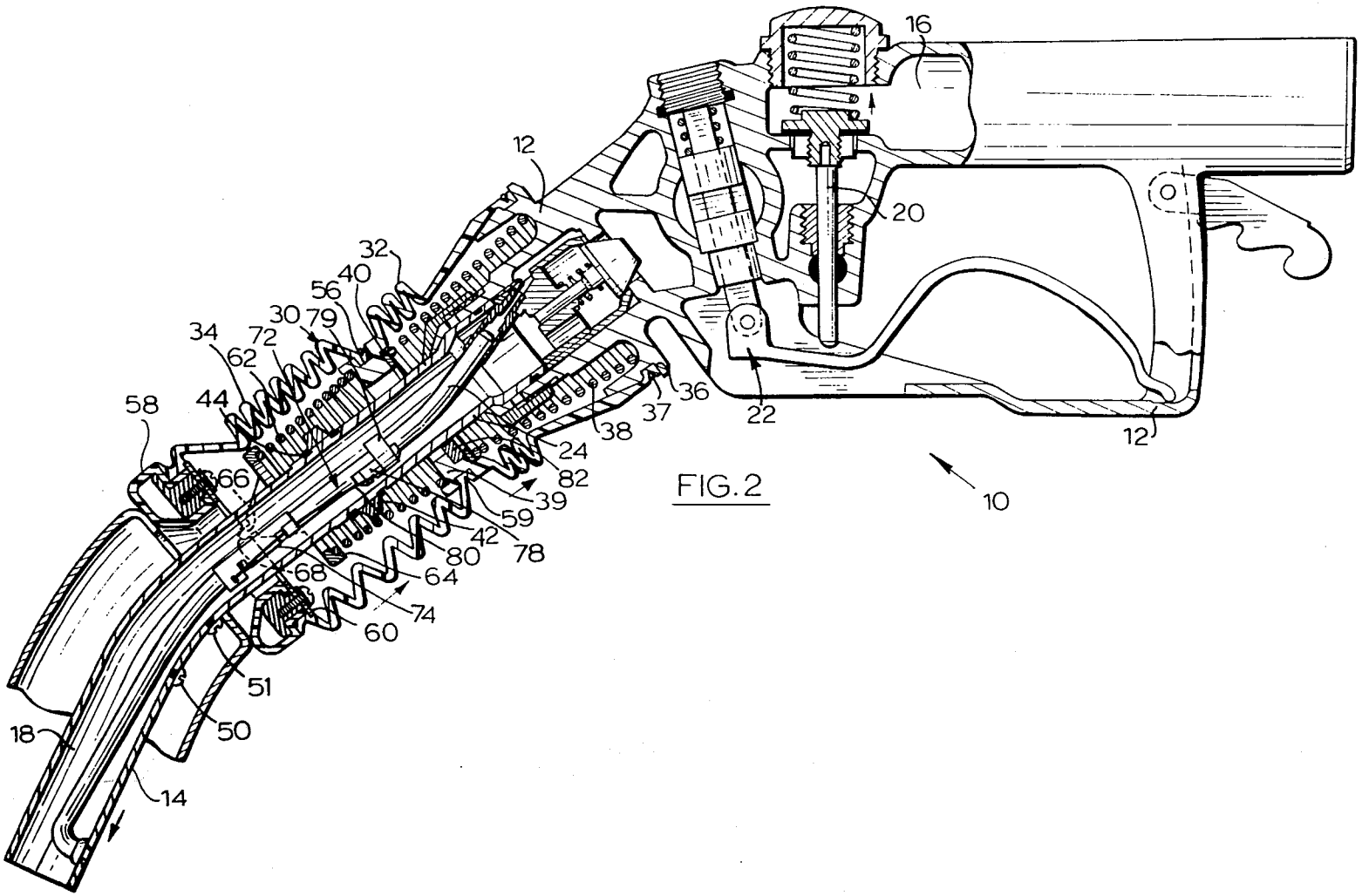
FIG. 2 is a section similar to FIG. 1 showing the nozzle operatively located within the fill tube of a gasoline storage tank.

With reference to FIG. 1 of the drawings, the reference numeral 10 refers generally to a vapour recovery dispenser nozzle according to an embodiment of the present invention. The nozzle consists of a main body portion 12 having a fluid discharge tube 14 extending from one end thereof. The main body portion 12 has a fluid passage generally identified by the reference numeral 16 extending therethrough which communicates with the fluid discharge passage 18 in the discharge tube 14. A main valve 20 is located in the passage 16 for opening and closing the passage to regulate the flow of liquid therethrough. A releasable latching mechanism generally identified by the reference numeral 22 is vacuum operated to automatically close the valve 20 when normal venting of the vacuum mechanism by way of the vent tube 24 is interrupted. The structure described above is well known and is not, therefore, described in detail. A nozzle having a vacuum release mechanism of the type which may be improved in accordance with an embodiment of the present invention is described in U.S. Pat. No. 3,196,980.

In FIG. 1 of the drawings, the reference numeral 30 refers generally to the vapour recovery shroud. The vapour recovery shroud 30 consists of an inner portion 32 and an outer portion 34. The inner portion has its upper end located in a channel 36 formed in the main body portion. An annular sealing collar 39 is formed as an integral portion of the outer end of the inner portion 32 of the shroud. A first compression spring 38 has its inner end bearing against the main body portion 12 and its outer end bearing against an annular spacer ring 40 which is located on the inner face of the sealing collar 39. The inner portion 32 of the shroud is formed with a plurality of circumferentially extending corrugations such that it is readily extended or contracted as required in use. The first spring 38 serves to urge the inner portion 32 towards its extended position. An annular sealing ring 42 is mounted on the discharge tube 14 and extends radially outwardly therefrom. O-rings 44 serve to secure the sealing ring 42 with respect to the discharge tube 14. The sealing collar 39 of the inner portion 32 sealingly engages the sealing ring 42 when the inner portion 32 of the shroud is in its extended position. The first spring 38 is designed to apply a sealing pressure to the sealing collar 39 when it is in engagement with the sealing ring 42.

The sealing relationship between the seat 42 and the collar 39 is such that when the inner portion 32 of the shroud is fully extended and a seal is made between the seat 42 and collar 39, recovered vapours which are located within the nozzle cannot escape to atmosphere through the open end of the shroud. While previous proposals have made provision for the sealing of the vapour recovery nozzle against the escape of recovered vapours therefrom, the seal has been made at the outermost end of the shroud against a sealing ring which is located within the filling tube of the gasoline tank of an automobile or the like in use. In contrast, it will be noted that the sealing seat 42 is located a substantial distance from the discharge end of the discharge tube 14. In fact, the seat 42 is located so far from the discharge end of the discharge tube 14 that the shroud 30 cannot be retracted a sufficient extent to permit the seat 42 to be located within the filling tube of a gasoline tank in use. The location of the seat 42 is such that it is possible to mount the automatic nozzle in the filling tube of a gas tank of an automobile or the like in a self-supporting position with the seat 42 located outwardly from the filling tube of the gas tank. For this reason, the diameter of the outer end portion of the filling tube which extends forwardly from the seat 42 may be such that it will fit readily within the input passage of the filling tube of a gasoline tank or the like. A plurality of screw heads 50 project a short distance outwardly from the discharge tube at longitudinally spaced intervals along the outer end portion thereof to engage with the end of a filling tube of a gasoline storage tank of an automobile or the like so that the nozzle may be self-supporting by engagement with the gas tank.

The outer portion 34 of the shroud has its inner end mounted in an annular recess 56 formed at the outer end of the inner portion 32. A clamping ring 59 serves to secure the inner end of the outer portion 34 of the shroud with respect to the outer end of the inner portion 32. The outer portion 34 of the shroud has a soft annular sealing ring 58 at the outer end thereof. A backing plate 60 is located at the inner face of the collar 58. A second extension spring 62 has one end bearing against the collar 39 of the inner portion 32 of the shroud and its outer end bearing against a support ring 64. The support ring 64 has a pair of support arms 66 projecting forwardly therefrom on opposite sides of the discharge tube 14 as described in U.S. Pat. No. 3,974,864 assigned to Emco Wheaton Inc. The arms 66 project into shallow recesses 68 formed in the backing plate 60 so that the backing plate 60 and the sealing ring 58 are free to rock about the ends of the support arms 66 to be aligned with the end of a filling tube of a gasoline tank in use. The second extension spring 62 is stronger than the first extension spring 38 for reasons that will be discussed hereinafter.

In order to prevent the discharge of liquid when the vapour recovery system is not in use, a secondary system is provided for disrupting the normal venting of the vent tube 24.

As shown in FIG. 3 of the drawings, a passage 70 is formed in the wall of the vent tube 24. The passage 70 communicates with the interior passage of the vent tube 24. A shallow transversely extending notch 71 is also formed on the wall of the vent tube 24.

The closure assembly for closing the passage 70 is generally identified by the reference numeral 72 and is shown in detail in FIG. 4 of the drawings. The assembly includes mounting bracket 74, a closure plate 78, a mounting ring 79 and a spring member 80. The bracket 74 has an arcuate shaped main body section formed from sheet metal and having four spring lugs 90 which extend inwardly thereof and a pair of elongated lugs 92 which extend downwardly from one end thereof. Lugs 90 serve to secure the bracket firmly about the vent tube 24 when the bracket is located in the position straddling the vent tube. The lugs 92 have passages 94 opening therethrough to receive the ends of the spring member 80 which extend transversely therebetween. The portions 81 of the spring 80 which extend between the lugs 92 rest in the shallow passage 71 (FIG. 3) formed in the tube 24 to prevent rotation of the bracket 74 with respect to the vent tube 24. A pair of tabs 96 (only one shown) are located at the forward end of the bracket 74 on opposite sides thereof. The tabs extend outwardly and upwardly from the edge of the bracket to form a fulcrum support for the spring. The tabs also serve to maintain the alignment of the spring with respect to the bracket and the closure member. Spring 80 has a generally rectangular configuration including a pair of parallel legs 95, transverse back arms 81 and a transverse front arm 83. The spring is made from round spring wire. The closure plate 78 has an arcuate configuration in which the inner surface has a curvature conforming closely to the curvature of the vent tube 24 so that when the inner surface bears against vent tube 24, it will serve to seal and close the passage 70. A slot 98 is formed on the outer face of the closure plate 78. The closure plate 78 is mounted on the end of the spring 80 by locating the transverse arm 83 of the spring 80 in the slot 98. The closure plate 78 is made from a plastic material, such as CELCON(Trade Mark) or DELRIN (Trade Mark). The closure plate 78 has an annular arcuate shaped recess 100 formed adjacent one end thereof. The closure plate 78 is sufficiently resilient to be inserted into the passage 102 in the collar 79. The collar 79 serves to limit the movement of the closure plate 78 with respect to the vent tube 24 to an extent sufficient to permit operation of the secondary venting system. As shown in FIG. 5 of the drawings, when the closure plate 78 is in the closed position, it bears against the underside of the tube 24 and closes the passage 70. In this position, there is a space between the inner surface of the collar 102 and the upper surface of the tube 24. When the closure member moves to the position shown in FIG. 6 of the drawings, the movement of the closure plate away from the vent tube is limited by contact of the collar 102 on the upper surface of the vent tube 24. The collar 102 serves to maintain the closure plate 78 closely adjacent the vent tube 24 under all conditions of use so that if, for example, the nozzle is dropped, the impact would not result in the closure plate 78 moving any significant distance away from its operative position with respect to the vent tube 24. The collar 102 is made from a material, such as mild steel or the like suitably plated to prevent corrosion.

It will be noted that movement of the closure plate away from the vent tube 24 causes the spring 80 to apply a force to the bracket 74 which tends to urge at least the front end of the bracket 74 towards the vent tube 24.

A permanent magnet 82 is mounted in the outer end of the inner portion 32 of the shroud outwardly from the discharge tube 14. When the outer portion 34 of the shroud is in its extended position shown in FIG. 1 with the collar 39 in sealing engagement with the seat 42, the permanent magnet 82 is located directly opposite the closure plate 78 and attracts the collar 102 in a direction away from the passage 70 and, thereby, moves the closure plate 78 to a position in which the passage 70 is open. Movement of the closure plate 78 to this position bends the spring 80 over the laterally projecting fulcrum tabs 96 of the bracket such that the spring applies a force to the closure plate 78 in a direction tending to close the second vent passage 70. When the closure plate 78 is in the open position, any liquid flowing through the discharge tube 14 will enter the passage 70 and block the vent tube 24, thereby disrupting normal venting by way of the vent tube and activating the release mechanism to release the latch and thereby close the main valve 20.

When the nozzle is located in a filling tube of a gas tank to a sufficient extent to displace the shroud rearwardly to a contracted position, the second spring 62 will be the first to yield and will serve to align the collar 58 with the end of the filling tube of the storage tank. The nozzle will not, however, operate until it is located within the fill tube to a sufficient extent to cause the second spring 38 to compress to an extent sufficient to move the permanent magnet 82 away from the ferrous collar 102 to an extent sufficient to permit the load applied by the spring 80 to overcome the magnet attraction of the magnet 82, thereby causing the closure plate 78 to move to a position closing the secondary vent passage 70. When the vent passage 70 is closed, the vent system will operate in a normal manner to permit flow of liquid through the nozzle until the level of liquid rises above the lower end of the vent tube in a conventional manner.

From the foregoing, it will be apparent that the mechanism employed to provide a secondary venting system is extremely simple and effective.

It will be noted that the seat member 42 serves the dual purpose of forming a seal with the sealing collar 39 and as a stop for accurately locating the permanent magnet 82 in alignment with the closure plate 78.

Various modifications of the structure of the preferred embodiment described above will be apparent to those skilled in the art. For example, while the shroud is defined and illustrated as being formed in two parts, the inner and outer portions of the shroud may be formed integrally with one another with the sealing collar formed as an integral part thereof. In addition, a permanent magnet may be incorporated into the secondary vent closure member, this magnet being of opposite polarity to that of the magnet carried by shroud so as to increase the attraction of one to the other.

These and other advantages of the apparatus of the present invention will be apparent to those skilled in the art.

What I claim as my invention is:

1. In a vapour recovery dispenser nozzle having a main body portion, a discharge tube projecting from one end of the main body portion, said discharge tube having an outer end portion thereof proportioned for ease of insertion into a filling tube of a liquid storage tank, a liquid flow passage extending through said main body and said discharge tube, vapour recovery passage means formed in said main body, an extensible vapour recovery shroud having an inner end and an outer end, said inner end of said shroud being mounted on said main body and communicating with said vapour recovery passage means of said main body, said shroud being disposed radially outwardly from said discharge tube and being movable between an extended position and a retracted position with respect to said main body, said shroud being normally urged towards said extended position, a first sealing collar at the outer end of said shroud for engagement with the end of the filling tube of a gas tank during filling thereof to direct vapour which is expelled from the tank to the vapour recovery passage means in the main body by way of the shroud, the improvement of a. sealing seat means on said discharge tube, said sealing seat means being located rearwardly from said outer end portion of said discharge tube to be disposed outwardly from the end of the filling tube of a liquid storage tank in use, b. second seal closure means disposed within said shroud and spaced a substantial distance rearwardly from said outer end of said shroud, said second seal closure means sealingly engaging said sealing seat means when said shroud is in its extended position whereby vapour which is located inwardly thereof cannot escape from within the shroud by way of the outer end thereof, said seal closure means being moved rearwardly away from said sealing seat when said shroud is moved to its retracted position in use whereby vapour expelled from the tank during filling may be directed through the shroud to the vapour recovery passage means of the main body.

2. A vapour recovery dispenser nozzle as claimed in claim 1, wherein said sealing seat means is in the form of an annular ring projecting radially from said discharge tube and said second seal closure means is in the form of an annular collar located on said shroud and projecting radially inwardly therefrom.

3. A vapour recovery dispenser nozzle as claimed in claim 2, wherein said shroud consists of inner and outer portions, the inner portion extending from said main body portion of the nozzle having an outer end spaced outwardly from said main body portion, said outer portion extending from the outer end of the inner portion to said first sealing collar, first spring means carried by said inner portion urging said inner portion to its extended position and second spring means carried by said outer portion urging said outer portion to its extended position, said second sealing collar being mounted on said inner portion of said shroud and said first spring means having a sufficient extended length to ensure that said second collar sealingly engages said sealing seat means when said inner portion is in its extended position.

4. A vapour recovery liquid dispensing nozzle as claimed in claim 3, wherein said second sealing collar is formed as an integral part of the outer end of the inner portion of said shroud.

5. A vapour recovery liquid dispensing nozzle as claimed in claim 4, in which an annular recess is formed at the outer end of the inner shroud portion, the inner end of the outer shroud portion being mounted in said annular recess and having means extending thereabout for securing it within said annular recess.

6. In a vapour recovery dispenser nozzle having a main body portion, a discharge tube projecting from one end of the main body portion, the discharge tube having an outer end portion thereof proportioned for ease of insertion into a filling tube of a liquid storage tank, a liquid flow passage extending through said main body and said discharge tube, vapour recovery passage means formed in said main body, an extensible vapour recovery shroud having an inner end and an outer end, said inner end of said shroud being mounted on said main body and communicating with said vapour recovery passage means of said main body, said shroud being disposed radially outwardly from said discharge tube and being movable between an extended position and a retracted position with respect to said main body, said shroud being normally urged towards said extended position, a first sealing collar at the outer end of said shroud for engagement with the end of the filling tube of a gas tank during filling thereof to direct vapour which is expelled from the tank to the vapour recovery passage means in the main body by way of the shroud, a vent tube extending through the liquid flow passage to form a primary vent passage and a vacuum operated release mechanism for automatically closing the flow control valve when the level of liquid in a tank being filled thereby rises above a level sufficient to block the end of the primary vent passage of the vent tube, the improvement of a. sealing seat means on said filling tube, said sealing seat means being located rearwardly from said outer end portion of said filling tube to be disposed outwardly from the end of the filling tube of a liquid storage tank in use, b. second seal closure means disposed within said shroud and spaced a substantial distance rearwardly from said outer end of said shroud, said second seal closure means sealingly engaging said sealing seat means when said shroud is in its extended position whereby vapour which is located inwardly thereof cannot escape from within the shroud by way of the outer end thereof, said second seal closure means being moved rearwardly away from said sealing seat when said shroud is moved to its retracted position in use whereby vapour expelled from the tank during filling may be directed through the shroud to the vapour recovery passage means of the main body, c. a secondary vent passage means in said vent tube communicating between the primary vent passage and the liquid discharge passage in the nozzle, whereby the flow of liquid through the discharge passage may disrupt the normal venting and activate the vacuum operated release mechanism to close the flow control valve, d. closure means mounted within said discharge tube for movement between the first position in which said secondary vent passage is open and a second position in which said secondary vent passage is closed, and e. magnetic activator means carried by said shroud, said magnetic activator means moving said closure means to said open position when the shroud is extended whereby normal venting may be disrupted and to the closed position when the shroud is retracted, thereby permitting normal venting of said vacuum operated release mechanism.

7. A vapour recovery liquid dispensing nozzle as claimed in claim 6 wherein said closure means is a ferrous member and said magnetic actuator means is a permanent magnet.

8. A vapour recovery liquid dispensing nozzle as claimed in claim 6 wherein said shroud consists of an inner portion having a first end connected to the nozzle and a second end spaced outwardly from the first end and first spring means carried by said inner portion urging said inner portion to its extended position, an outer portion extending from the second end of the inner portion and having an outer end spaced from the second end of the inner portion, a first sealing collar at the outer end of the outer portion for engagement with the end of a filling tube of a gas tank during filling thereof, second spring means carried by the outer portion for urging the outer portion to its extended position, said magnetic actuator means being mounted on said inner portion of said shroud, said first spring means being lighter than said second spring means to yield upon engagement of the first sealing collar with a filling tube to ensure that the magnetic actuator means is moved to a position in which the vent closure means is in its second position permitting normal venting before the nozzle is fully extended into the filled tube.

9. A vapour recovery liquid dispensing nozzle as claimed in claim 8 including sealing seat means on said filling tube, said sealing seat means being located within said shroud when said shroud is in said extended and retracted positions, and a second sealing collar mounted on said inner portion of said shroud and sealingly engaging said sealing collar when said inner portion of said shroud is in its extended position whereby vapour which is located inwardly thereof cannot escape from within the shroud by way of the outer end thereof, said sealing collar being movable rearwardly away from said sealing seat when said inner portion of said shroud is moved to its retracted position in use, whereby vapour expelled from the tank during filling may be directed through the shroud to the vapour recovery passage means of the main body.

10. In a vapour recovery liquid dispensing nozzle of the type having a vacuum operated release mechanism for automatically closing the flow control valve when the level of liquid in a tank being filled thereby rises to a level closing the end of the primary vent passage of the vent tube, the vent tube extending through the liquid discharge passage of the nozzle, and an extensible vapour recovery shroud extending about the discharge tube for directing vapour to the recovery passage of the nozzle, the shroud being movable from an extended position to a retracted position when the nozzle is operatively located within the neck of a liquid storage tank with the vapour recovery passage thereof communicating with the tank by way of the shroud, the improvement of a. a secondary vent passage means in said vent tube communicating between the primary vent passage and the liquid discharge passage in the nozzle, whereby the flow of liquid through the discharge passage may disrupt the normal venting and activate the vacuum operated release mechanism to close the flow control valve, b. closure means mounted within said discharge tube for movement between the first position in which said secondary vent passage is open and a second position in which said secondary vent passage is closed, and c. magnetic activator means carried by said shroud, said magnetic activator means moving said closure means to said open position when the shroud is extended whereby normal venting may be disrupted and to the closed position when the shroud is retracted, thereby permitting normal venting of said vacuum operated release mechanism.

11. A vapour recovery liquid dispensing nozzle as claimed in claim 10 wherein said closure means is a ferrous member and said actuator means is a permanent magnet.

12. A vapour recovery liquid dispensing nozzle as claimed in claim 10 wherein said closure member comprises a ferrous member and spring means mounted on said vent tube and engaging said ferrous member and mounting said ferrous member in close proximity to said secondary vent passage, said spring means urging said ferrous member towards its closed position with respect to said secondary vent passage, said actuator means being a permanent magnet of sufficient strength to attract said ferrous member to its open position when said shroud is in its extended position and being of insufficient strength to prevent said ferrous member from closing said secondary vent passage when said shroud is in its retracted position.

13. A vapour recovery liquid dispensing nozzle as claimed in claim 10 wherein said shroud consists of an inner portion having a first end connected to the nozzle and a second end spaced outwardly from the first end and first spring means carried by said inner portion urging said inner portion to its extended position, an outer portion extending from the second end of the inner portion and having an outer end spaced from the second end of the inner portion, a first sealing collar at the outer end of the outer portion for engagement with the end of a filling tube of a gas tank during filling thereof, said spring means carried by the outer portion for urging the outer portion to its extended position, said magnetic actuator means being mounted on said inner portion of said shroud, said first spring means being lighter than said second spring means to yield upon engagement of the first sealing collar with a filling tube to ensure that the magnetic actuator means is moved to a position in which the vent closure means is in its second position permitting normal venting before the nozzle is fully extended into the filled tube.

14. A vapour recovery liquid dispensing nozzle as claimed in claim 2 wherein said closure member comprises a ferrous member and spring means mounted on said vent tube and engaging said ferrous member and mounting said ferrous member in close proximity to said secondary vent passage, said spring means urging said ferrous member towards its closed position with respect to said secondary vent passage, said actuator means being a permanent magnet of sufficient strength to attract said ferrous member to its open position when said shroud is in its extended position and being of insufficient strength to prevent said ferrous member from closing said secondary vent passage when said shroud is in its retracted position.

15. In a vapour recovery liquid dispensing nozzle as claimed in claim 10, wherein said closure means and said magnetic actuator means are permanent magnets oriented to attract one another when said shroud is in its extended position.

* * * * *

Notice of Adverse Decision in Interference

In Interference No. 100,179, involving Patent No. 4,060,110, A. M. Bower, VAPOUR RECOVERY NOZZLE, final judgment adverse to the patentee was rendered Feb. 10, 1983, as to claims 1 and 2.

[*Official Gazette July 12, 1983.*]